United States Patent [19]

Evenson

[11] Patent Number: 4,924,898

[45] Date of Patent: May 15, 1990

[54] VACUUM ASSISTED MATERIAL MOVER

[75] Inventor: William R. Evenson, South Houston, Tex.

[73] Assignee: The GNI Group, Inc., Webster, Tex.

[21] Appl. No.: 62,625

[22] Filed: Jun. 16, 1987

[51] Int. Cl.[5] ..... E03B 5/00

[52] U.S. Cl. ..... 137/566; 417/244; 417/517; 417/900; 137/615

[58] Field of Search ..... 417/900, 517, 244; 137/566, 615, 899.1

[56] References Cited

U.S. PATENT DOCUMENTS

| | | | |
|---|---|---|---|
| 547,538 | 10/1895 | Coffey | 417/900 |
| 3,085,587 | 4/1963 | O'Shields | 137/566 |
| 3,809,505 | 5/1974 | Dobson, Sr. et al. | 417/900 |
| 4,172,617 | 10/1979 | de Koning | 137/566 |
| 4,613,290 | 9/1986 | Evenson | 417/517 |
| 4,659,293 | 4/1987 | Evenson | 417/900 |
| 4,661,046 | 4/1987 | Ruyle | 417/244 |

*Primary Examiner*—A. Michael Chambers

*Attorney, Agent, or Firm*—Guy E. Matthews

[57] ABSTRACT

A pumping system for sludge including hazardous waste material and other viscous material includes a vacuum pump for drawing sludge into and through an intake line to a separator where the heavier components of the sludge descend into a closed tank hopper. A positive displacement pump discharges the sludge from the closed tank hopper through a delivery line to a remote point of disposal or storage. A centrifugal pump attached to the sludge receiving end of the intake line and being hydraulically driven acts as a booster for the vacuum pump by pushing sludge into and through the intake line while helping to overcome the head pressure therein as well as friction in the intake line. The vacuum in the intake line created by the vacuum pump enables the submerged centrifugal pump to feed itself. The centrifugal pump also functions as a cutter head helping to liquefy heavy sludge. A substantial increase in the material moving capacity of the system is realized by using the centrifugal pump in conjunction with the vacuum pump.

7 Claims, 1 Drawing Sheet

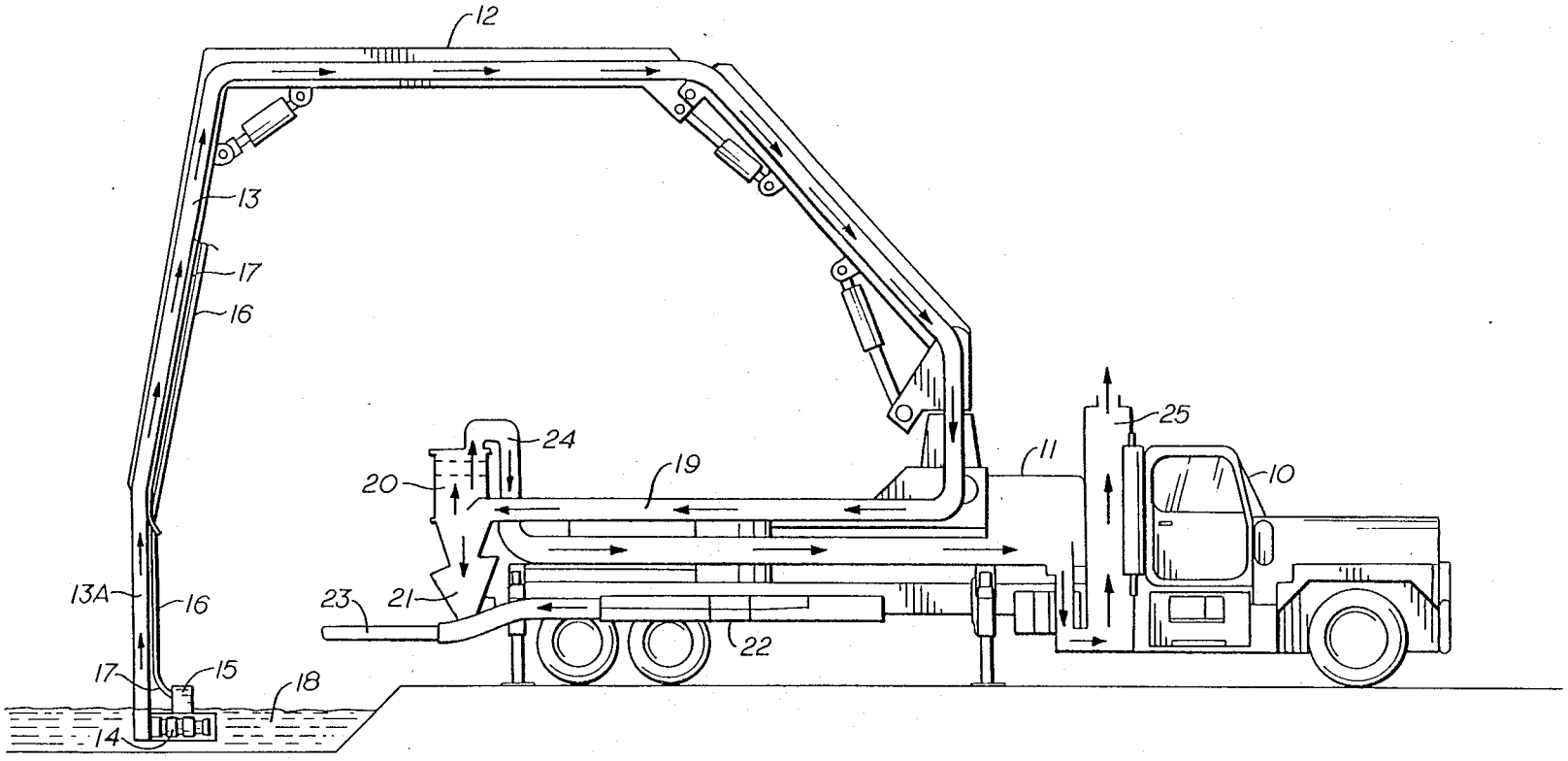
10
25
11
22
19
24
12
20
21
23
18
13
17
16
15
16
13A
17
14

VACUUM ASSISTED MATERIAL MOVER

BACKGROUND OF THE INVENTION

1. Technical Field

This invention relates to a pumping system for sludge and the like and, more particularly, relates to a vacuum pumping system having an independently operated booster pump on the sludge intake line of the pumping system.

2. The Prior Art

In U.S. Pat. No. 4,613,290 entitled EVACUATED PUMPING SYSTEM, William R. Evenson, the subject inventor, there is disclosed an evacuated pumping system for sludge and the like in which viscous sludge is sucked in to a closed tank hopper through an intake line extending to a source of the sludge. A positive displacement pump connected with the closed tank hopper pumps the sludge from the tank hopper through a discharge line extending to a remote location for disposal or storage of the sludge. While the system of U.S. Pat. No. 4,613,290 works very well, there are types of materials encountered which tend to resist pumping and the pressure head in the sludge intake line plus friction developing in the line are factors which can render the pumping operation very difficult and greatly minimize production through the system.

Accordingly, the objective of the present invention is to improve on the evacuated pumping system of the above-referenced prior art patent by overcoming the described difficulties in pumping of certain very heavy sludges and other materials which resist flowing in the pumping system.

Another object of the invention is to greatly increase the productivity of the evacuated pumping system by the addition thereto of an independently driven centrifugal booster pump near the mouth of the evacuated intake line of the system, the booster pump also helping to liquefy the heavy material being drawn into the intake line.

Other objects and advantages of the invention will become apparent to those skilled in the art during the course of the following description.

SUMMARY OF THE INVENTION

The invention is best summarized as an evacuated pumping system for heavy sludge or the like in which a vacuum pump sucking material into a long intake line of the system is assisted in its operation by an independently driven centrifugal pump at the mouth of the intake line which tends to liquefy sludge and pushes the sludge into and through the intake line while overcoming the pressure head existing in the intake line, as well as frictional resistance to material flow through the line.

The centrifugal pump is preferably hydraulically driven and may be completely submerged within the sludge or other waste material requiring pumping. Chopper, trash and squeeze centrifugal pumps as well as the generally used rotary centrifugal pump can be utilized. A unique feature of the invention is that the vacuum being maintained in the intake line at all times enables the centrifugal pump to feed itself with sludge, whereas, in the absence of vacuum in the intake line, the self-feeding of the centrifugal pump would be impossible in the types of material being handled by the system.

The improved pumping system can be stationary, truck or trailer mounted, or barge mounted. The intake suction line can be attached to an articulated boom or simply used without a boom.

The positive displacement pump associated with the closed tank hopper into which the sludge is delivered from the intake line can pump sludge great distances through a discharge line of sufficient length, up to one-half mile or more.

BRIEF DESCRIPTION OF THE DRAWINGS

The drawing FIGURE is a schematic view of a vacuum assisted material mover according to the present invention.

DETAILED DESCRIPTION

Referring to the drawing in detail wherein like numerals designate like parts, a suitable truck 10 having approximately a 320 h.p. power plant mounts a vacuum pump 11 thereon having a sludge pumping capacity of approximately 1000 c.f.m. at 29" HG. vacuum. Also mounted on the truck 10 is a 100 foot three-stage articulated boom 12 which may be based on a turntable. A sludge intake hose 13 extends along the length of the articulated boom and beyond its free end to form an unsupported intake line section or extension 13*a*.

A very key feature of the present invention resides in the provision of a centrifugal type booster pump 14 suitably attached to the free end of the extension 13*a* in communication with the mouth of this extension. The centrifugal pump 14 is operated by a hydraulic motor 15 having flexible hydraulic supply and outlet lines 16 and 17 which extend along the intake line extension 13*a* and along the articulated boom, being suitably attached thereto. A stationary source of hydraulic fluid, not shown, on the truck 10 supplies the hydraulic motor 15 through the lines 16 and 17. The centrifugal pump 14 along with the mouth of the intake line 13*a* can be completely submerged in heavy industrial sludge 18 or the like during the operation of the system.

The sludge being drawn through the intake line 13 by the combined operation of the pumps 11 and 14 is delivered through a horizontal section 19 of the intake line to a separator 20 from which the heavier components of the material descend into a closed tank hopper 21 which is in communication with a positive displacement pump 22 on the truck 10. This pump 22 can be a dual cylinder alternating piston pump of the type disclosed in the referenced patent application.

From the tank hopper 21, the pump 22 discharges sludge through a long delivery line 23 which can extend to a remote location one-half mile or more distant.

The separator 20 has a light material discharge line 24 leading therefrom to a filtered exhaust 25 in the embodiment of the invention illustrated in the drawing.

In the operation of the system, the submerged hydraulically driven centrifugal pump 14 can feed itself with the heavy sludge 18 because of the high vacuum maintained in the intake line 13 by the vacuum pump 11. Without this vacuum, the centrifugal pump 14 could not operate successfully.

When operating in conjunction with the vacuum pump 11, the centrifugal pump pushes the sludge into and through the intake line 13 and counteracts the pressure head existing in the intake line while helping to overcome frictional resistance to flow in the line. The utilization of the two pumps, as described, dramatically increases the productivity of the system for pumping thick sludge or other wastes, such as slop oil, sewage, or various industrial wastes.

The centrifugal pump 14 serves an additional useful purpose as a cutter head on the end of the intake line extension 13*a*, chopping up and liquefying the sludge 18 which may be a thick semi-solid in its environment at the bottom of a pit or barge.

The advantages of the invention should now be apparent to those skilled in the art without the need for further explanation herein.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A pumping system for sludge and the like comprising, a vacuum pump, a sludge intake line connected with the vacuum pump and extending to a source of sludge requiring pumping, a tank hopper connected with the sludge intake line and receiving sludge therefrom, a sludge discharge line connected with and leading from the tank hopper to a remote point of sludge disposal, a positive displacement pump connected with the tank hopper to pump sludge therefrom into and through said discharge line, and an independently operated booster pump on the sludge intake line adjacent to the mouth of such line and operating in conjunction with said vacuum pump to force sludge into and through the intake line in opposition to frictional resistance to material flow and the pressure head existing in the intake line.

2. A pumping system for sludge and the like as defined in claim 1, and said booster pump comprising a hydraulically driven submersible centrifugal pump utilizing vacuum in said intake line created by the vacuum pump to feed the centrifugal pump with sludge.

3. A pumping system for sludge and the like as defined in claim 2, and a hydraulic drive motor for the centrifugal pump on the centrifugal pump.

4. A pumping system for sludge and the like as defined in claim 1, and a vehicular support for the pumping system, and an articulated boom on the vehicular support carrying said intake line and booster pump.

5. A pumping system for sludge and the like as defined in claim 4, and the intake line including a free extension beyond the free end of the articulated boom, and said booster pump comprising a centrifugal pump on said free extension adjacent to the mouth thereof.

6. A pumping system for sludge and the like comprising, an elongated flexible sludge intake line having a mouth adapted to be located at a source of sludge requiring pumping, an elongated sludge discharge line adapted to extend to a remote point of sludge disposal, a vacuum pump connected with the sludge intake line to maintain a partial vacuum in said line, a positive displacement pump connected with said discharge line and being operable to pump sludge therethrough being delivered from said intake line, and an independently operated pump carried by said intake line substantially at the mouth thereof to feed sludge into the mouth of the intake line and push the sludge through the intake line in opposition to frictional resistance and a pressure head existing in the intake line while said vacuum pump simultaneously is sucking the sludge into the independently operated pump and into and through said intake line.

7. A pumping system for sludge and the like as defined in claim 6, and the independently operated pump comprising a centrifugal pump adapted to somewhat liquefy the sludge entering the intake line.

* * * * *